US007267502B2

(12) United States Patent
Sawai

(10) Patent No.: US 7,267,502 B2
(45) Date of Patent: Sep. 11, 2007

(54) IMAGE FORMING APPARATUS INCLUDING A FEED ROLLER AND PRESS-FIT MEMBER FOR ATTACHING GEAR TO ROLLER SHAFT

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 122 days.

(21) Appl. No.: 11/037,037

(22) Filed: Jan. 19, 2005

(65) Prior Publication Data

US 2005/0156375 A1 Jul. 21, 2005

(30) Foreign Application Priority Data

Jan. 19, 2004 (JP) ..... 2004-010546

(51) Int. Cl.
*B65H 5/06* (2006.01)
*B41J 13/076* (2006.01)

(52) U.S. Cl. ..... 400/641; 400/629; 400/636; 271/272; 347/218

(58) Field of Classification Search ..... 400/629, 400/634, 636, 636.2, 637, 641, 120.01; 347/218; 271/272

See application file for complete search history.

(56) References Cited

FOREIGN PATENT DOCUMENTS

| | | | |
|---|---|---|---|
| JP | UM-A-61-132344 | | 8/1986 |
| JP | 62-108076 A | | 5/1987 |
| JP | 4-105631 U | | 9/1992 |
| JP | 06127724 A | * | 5/1994 |
| JP | 08231077 A | * | 9/1996 |
| JP | 9-150983 A | | 6/1997 |
| JP | 9-240873 A | | 9/1997 |
| JP | 10196671 A | * | 7/1998 |

OTHER PUBLICATIONS

Japanese Office Action dated Jan. 19, 2007 with English translation (Four (4) pages).

* cited by examiner

*Primary Examiner*—Leslie J. Evanisko
(74) *Attorney, Agent, or Firm*—Crowell & Moring LLP

(57) ABSTRACT

In a thermally transcribing printer including a frame, a roller made of a metal for feeding sheet at constant speed, a gear made of a resin, a motor, a press-fit engaging member, and a compression coil spring, the roller includes a shaft portion attached to project from an inner side to an outer side of the frame 1 and the press-fit engaging member is press-fitted to the shaft portion. Further, the gear includes a shaft inserting hole in a circular shape inserted from an outer side of the press-fitted engaging member made of a metal into a shaft portion of the roller, and four second engaging portions provided at intervals of 90 degrees between the shaft inserting hole and an outer peripheral portion of the gear and having a predetermined length in a rotational direction.

11 Claims, 10 Drawing Sheets

PRIOR ART

PRIOR ART

IMAGE FORMING APPARATUS INCLUDING A FEED ROLLER AND PRESS-FIT MEMBER FOR ATTACHING GEAR TO ROLLER SHAFT

BACKGROUND OF THE INVENTION

1. Field of the Invention

The present invention relates to a thermally transcribing printer and an image forming apparatus, particularly relates to a thermally transcribing printer and an image forming apparatus including a roller for feeding sheet.

2. Description of the Related Art

In a background art, there is known an image forming apparatus of a thermally transcribing printer or the like including a roller for feeding sheet (refer to, for example, JP-UM-A-61-132344).

JP-UM-A-61-132344, mentioned above, discloses a structure in which a roll main body and a rotating shaft are fixed by fixing a stopper having an arm is fixed to the rotating shaft by inserting a pin into a pin inserting hole of the rotating shaft and engaging the arm of the stopper with an engaging hole of the roll main body at a portion of fixing the roll main body (roller) for feeding sheet and the rotating shaft attached with the roll main body.

FIG. 17 is a perspective view showing a total constitution of a thermally transcribing printer according to an example of a background art. FIG. 18 is a sectional view showing a structure of attaching a roller for feeding sheet of the thermally transcribing printer of the background art shown in FIG. 17 at constant speed. FIG. 19 is a perspective view showing a structure of attaching the roller shown in FIG. 18 to a gear. An explanation will be given of a structure of the thermally transcribing printer according to the example of the background art.

As shown by FIG. 17, the thermally transcribing printer apparatus of the background art includes a frame 101 made of a metal, a roller 102 made of a metal for feeding sheet at constant speed, a gear 103 made of a resin, a motor 104 for driving to rotate the gear, a motor bracket 105 made of a metal, a leaf spring 106 made of a metal, bearing members 107 and 108 (refer to FIG. 18) an ink sheet winding gear 109, a roller shaft drive gear 110, a plurality of middle gears 111, a sheet charging and discharging roller 112, a roller shaft 113 of the sheet charging and discharging roller 112, an ink sheet case 114, and a sheet bottom receiving guide 115. As shown by FIG. 18, a shaft portion 102*a* of one end of the roller 102 made of a metal for feeding sheet at constant speed is rotatably inserted into the bearing member 108 attached to one side face of the frame 101. Further, an oval shape portion 102*b* (refer to FIG. 19) formed at an outer side of the shaft portion 102*a* of the roller 102 is fitted to the gear 103. As shown by FIG. 19, the oval shape portion 102*b* of the roller 102 is machined in an oval shape and fitted to a fitting hole 103*a* in an oval shape of the gear 103. Thereby, the roller 102 and the gear 103 can be connected so as not to be rotated idly. Further, other end 102*c* of the roller 102 is rotatably inserted into the bearing member 107 attached to other side face of the frame 101. The motor 104 is attached to the motor bracket 105 made of a metal attached to the frame 101. The motor 104 functions as a drive source for driving the ink sheet winding gear 109 and the roller shaft drive gear 110. Further, as shown by FIG. 18, the leaf spring 106 made of a metal is fixed to the motor bracket 105 made of a metal. A movable end 106*a* of the leaf spring 106 is arranged to be brought into contact with a side face of the oval shape portion 102*b* of the roller 102. Thereby, the leaf spring 106 functions as the ground.

Next, an explanation will be given of operation of feeding sheet at constant speed of the thermally transcribing printer according to the example of the background art. As operation of feeding sheet at constant speed of the printer of the background art, as shown by FIG. 17, a drive force of the motor 104 is transmitted to the gear 103, the ink sheet winding gear 109 and the roller shaft drive gear 110 via the plurality of middle gears 111. At this occasion, the drive force is transmitted from the gear 103 to the roller 102 via the oval shape portion 102*b* and the shaft portion 102*a* of the roller 102. Thereby, the roller 102 is rotated while being supported by the bearing members 107 and 108. As a result, sheet (not illustrated) is fed at constant speed. Further, the drive force is also transmitted from the ink sheet winding gear 109 to an ink sheet winding roller shaft (not illustrated) and therefore, ink sheet is wound. Further, the drive force is transmitted from the roller shaft drive gear 110 to the roller shaft 113 and therefore, sheet (not illustrated) is carried in a sheet charging direction or a sheet discharging direction.

According to the thermally transcribing printer of the background art shown in FIG. 17 through FIG. 19, in order to connect the roller 102 and the gear 102 so as not to be rotated idly, it is necessary to form the oval shape portion 102*b* or a D-shape portion at the outer side of the shaft portion 102*a* of the roller 102 by machining requiring a time period in working. Therefore, there poses a problem that part cost becomes expensive.

Further, according to the structure disclosed in JP-UM-A-61-132344, mentioned above, it is necessary to provide the pin inserting hole at the rotating shaft in order to connect the rotating shaft and the roller (roll main body) so as not to be rotated idly and therefore, there poses a problem that a time period is taken in working to bore the rotating shaft.

SUMMARY OF THE INVENTION

The invention has been carried out in order to resolve the above-described problems and it is an object of the invention to provide a thermally transcribing printer and an image forming apparatus capable of reducing a time period of working a member for connecting a roller and a gear so as not to be rotated idly.

According to a first aspect of the invention, there is provided a thermally transcribing printer which is a thermally transcribing printer including a frame made of a metal, a roller made of a metal including a shaft portion attached to the frame to project from an inner side to an outer side of the frame via a bearing member for feeding a sheet at a constant speed, a gear made of a resin attached to a portion of the shaft portion of the roller projected to the outer side of the frame for rotating the roller, and a drive motor for driving to rotate the gear, further including a press-fit engaging member made of a metal press-fitted to the portion of the shaft portion of the roller projected to the outer side of the frame and engaged with the gear, and a compression coil spring made of a metal arranged between the press-fit engaging member and the frame for urging the press-fit engaging member in a direction of the outer side of the frame. The gear made of the resin includes a shaft inserting hole in a circular shape inserted from an outer side of the press-fit engaging member to the shaft portion of the roller, and a plurality of engaging holes provided at intervals of a predetermined angle between the shaft inserting hole and an outer peripheral portion of the gear and having a predetermined hole length in a rotational direction, and the press-fit engaging member includes a shaft press-fitting portion press-fitted to the shaft portion of the roller made of the metal and a plurality of engaging portions provided at positions in correspondence with the engaging holes, engaged with the plurality of engaging holes of the gear and including a length in a rotational direction equivalent to or larger than a length in the rotational direction of the engaging hole.

According to the thermally transcribing printer of the first aspect of the invention, as described above, the shaft portion of the roller and the gear can be connected so as not to be rotated idly by providing the plurality of engaging holes at the gear for rotating the roller made of the metal for feeding the sheet at constant speed and providing the press-fit engaging member having the shaft press-fitting portion press-fitted to the shaft portion of the roller and the engaging portions engaged with engaging holes of the gear without providing an oval shape portion, a pin inserting hole or the like at the shaft portion of the roller. Thereby, the shaft portion of the roller and the gear can be connected so as not to be rotated idly without forming an oval shape portion, a pin inserting hole or the like requiring a time period in working. As a result, a time period of working the shaft portion of the roller and therefore, working cost can be reduced. Further, by providing the compression coil spring made of the metal for urging the press-fit engaging member to the direction of the outer side of the frame, static electricity generated between the roller made of the metal and sheet or the bearing member is escaped to a side of the frame via the press-fit engaging member and the compression coil spring. Thereby, the roller can be grounded to the frame and therefore, a failure of the apparatus caused by static electricity of the roller can be prevented. Further, the press-fit engaging member is urged in the direction of the outer side of the frame by the compression coil spring and therefore, when the roller feeds sheet at constant speed, the roller can be restrained from being moved in a horizontal direction. As a result, accuracy of feeding sheet can be promoted. Further, by providing the engaging portion having the length in the rotational direction equivalent to or larger than the length in the rotational direction of the engaging hole of the gear at the press-fitting engaging member, the engaging hole of the gear and the engaging portion of the press-fit engaging member can be engaged without a clearance therebetween in the rotational direction. Thereby, in transmitting a drive force transmitted from the motor from the gear to the press-fit engaging member, play (rattle) can be restrained from being produced between the gear and the press-fit engaging member in the rotational direction. As a result, accuracy of feeding sheet can further be promoted. Further, by engaging the plurality of engaging holes provided at predetermined angular intervals between the shaft inserting hole of the gear and the outer peripheral portion of the gear with the plurality of engaging portions of the press-fit engaging member in correspondence therewith, the drive force is transmitted by a plurality of connecting portions. Thereby, in transmitting the drive force transmitted from the motor from the gear to the roller via the press-fit engaging member, even when a large load is applied thereon, the large load is dispersed to the plurality of connecting portions and therefore, the gear can be restrained from being destructed.

According to a second aspect of the invention, there is provided an image forming apparatus including a roller made of a metal for feeding a sheet, a press-fit engaging member including a shaft press-fitting portion press-fitted to a shaft portion of the roller and a first engaging portion, and a gear including a second engaging portion attached to the shaft portion of the roller and engageable with the first engaging portion of the press-fit engaging member.

According to the image forming apparatus of the second aspect of the invention, as described above, the shaft portion of the roller and the gear can be connected so as not to be rotated idly by providing the second engaging portion at the gear for rotating the roller made of the metal for feeding sheet at constant speed and providing the press-fit engaging member having the shaft press-fitting portion press-fitted to the shaft portion of the roller and the first engaging portion engaged with the second engaging portion, without providing an oval portion, a pin inserting hole or the like at the shaft portion of the roller. Thereby, the shaft portion of the roller and the gear can be connected so as not to be rotated idly without forming an oval shape portion, a pin inserting hole or the like requiring a time period in working at the shaft portion of the roller. As a result, a time period of working the shaft portion of the roller can be reduced and therefore, working cost can be reduced.

Preferably, the image forming apparatus according to the second aspect of the invention further includes a frame made of a metal rotatably attached with the roller made of the metal, in which the press-fit engaging member is made of a metal, and the apparatus further includes a compression coil spring made of a metal arranged between the press-fit engaging member and the frame for urging the press-fit engaging member in a direction of an outer side of the frame. When constituted in this way, static electricity generated between the roller made of the metal and sheet or a bearing member is escaped to a side of the frame via the press-fit engaging member and the compression coil spring. Thereby, the roller can be grounded to the frame and therefore, a failure of the apparatus caused by static electricity of the roller can be prevented. Further, the press-fit engaging member is urged in the direction of the outer side of the frame by the compression coil spring and therefore, when the roller feeds sheet at constant speed, the roller can be restrained from being moved in a horizontal direction. As a result, accuracy of feeding sheet can further be promoted.

Preferably, in the image forming apparatus according to the second aspect of the invention, the gear includes a shaft inserting hole in a circular shape inserted from an outer side of the press-fit engaging member to the shaft portion of the roller, a plurality of the second engaging portions of the gear are provided at intervals of a predetermined angle between the shaft inserting hole and an outer peripheral portion of the gear, and a plurality of the first engaging portions of the press-fit engaging member are provided at positions in correspondence with the second engaging portions of the gear and engaged with the plurality of second engaging portions of the gear. When constituted in this way, in transmitting the drive force transmitted from the motor from the gear to the roller via the press-fit engaging member, even when a large load is applied thereon, the large load is dispersed to the plurality of connecting portions and therefore, the gear can be restrained from being destructed.

Preferably, in the image forming apparatus according to the second aspect of the invention, the first engaging portion of the press-fit engaging member includes a projected piece projected to a side of the second engaging portion of the gear, and the second engaging portion of the gear includes an engaging hole engageable with the projected piece of the press-fit engaging member. When constituted in this way, by engaging the projected piece of the press-fit engaging member and the engaging hole of the gear, the shaft portion of the roller and the gear can be connected so as not to be rotated idly easily without providing an oval shape portion, a pin inserting hole or the like at the shaft portion of the roller.

In this case, preferably, the projected piece of the press-fit engaging member is provided with a length in a rotational direction equivalent to or larger than a length in the rotational direction of the engaging hole of the gear. When constituted in this way, the engaging hole of the gear and the projected piece of the press-fit engaging member are engaged without a clearance therebetween in the rotational direction. Thereby, in transmitting the drive force transmitted from the motor from the gear to the press-fit engaging member, play (rattle) can be restrained prom being produced between the gear and the press-fit engaging member in the rotational direction. As a result, accuracy of feeding sheet can further be promoted.

In the image forming apparatus according to the second aspect of the invention, preferably, the first engaging portion of the press-fit engaging member includes a front end portion having a bifurcated branch portions, and the second engaging portion of the gear includes a rib pinched by the branch portions of the front end portion of the first engaging portion. When constituted in this way, by engaging the bifurcated branch portions of the press-fit engaging member and the rib of the gear, the shaft portion of the roller and the gear can be easily connected so as not to be rotated idly without providing an oval shape portion, a pin inserting hole or the like at the shaft portion of the roller.

In the image forming apparatus according to the second aspect of the invention, preferably, the first engaging portion of the press-fit engaging member includes a projected piece, and the second engaging portion of the gear includes a pair of ribs for holding to pinch the projected piece of the first engaging portion. When constituted in this way, by engaging the projected piece of the press-fit engaging member and the pair of ribs of the gear, the shaft portion of the roller and the gear can easily be connected so as not to be rotated idly without providing an oval shape portion, a pin inserting hole or the like at the shaft portion of the roller.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

An explanation will be given of an embodiment of the invention in reference to the drawings as follows.

First Embodiment

Figure 1:
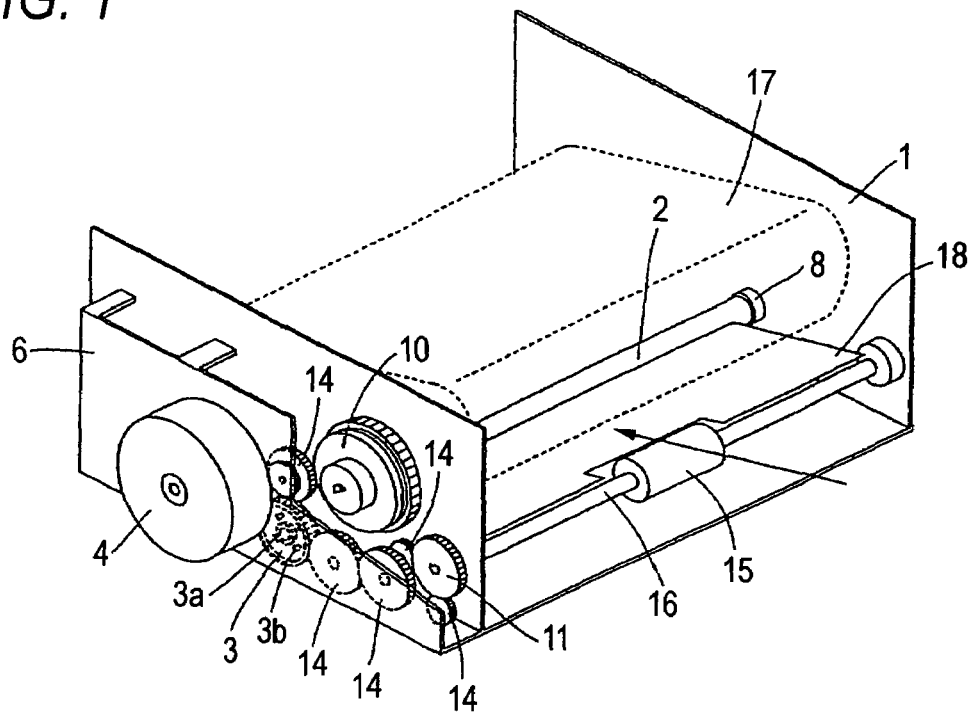
FIG. 1 is a perspective view showing a total structure of a thermally transcribing printer according to a first embodiment of the invention.
Figure 2:
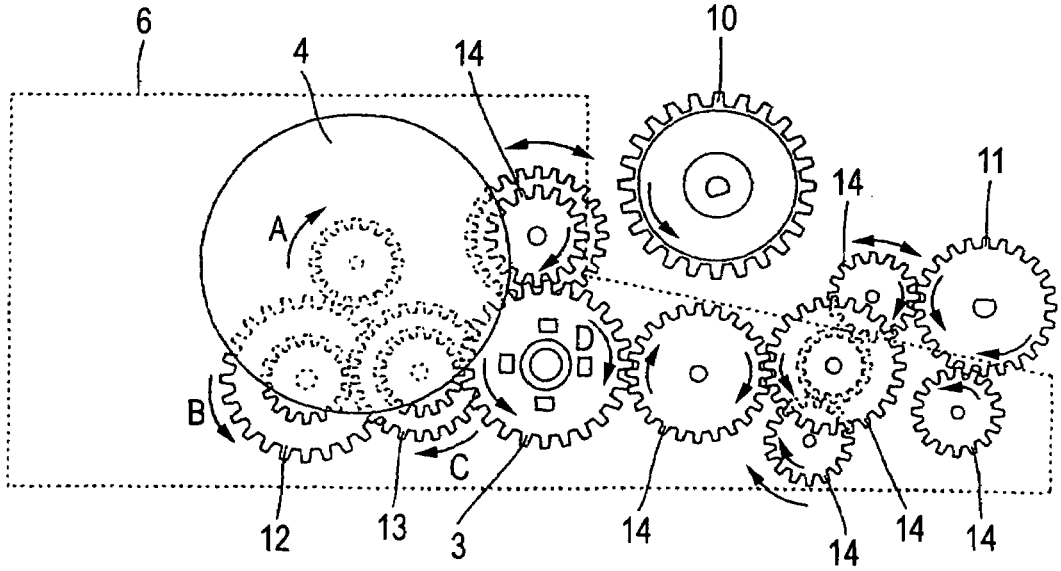
FIG. 2 is a front view showing a motor and respective gears of the thermally transcribing printer according to the first embodiment shown in FIG. 1.
Figure 3:
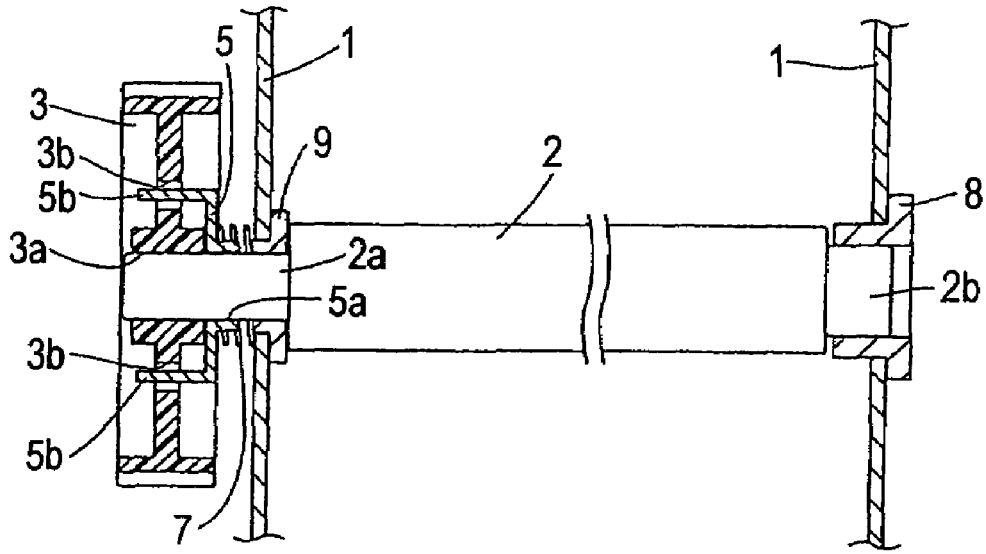
FIG. 3 is a sectional view showing a state of attaching a roller, a press-fit engaging member and a gear of the thermally transcribing printer according to the first embodiment shown in FIG. 1.
Figure 4:
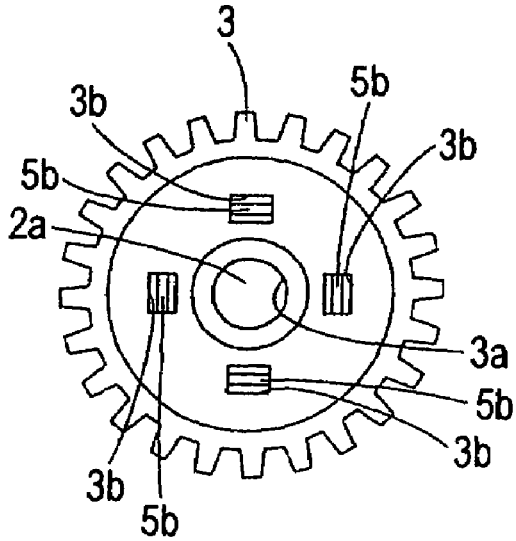
FIG. 4 is a front view showing a state of engaging the press-fit engaging member and the gear according to the first embodiment shown in FIG. 3.
Figure 5:
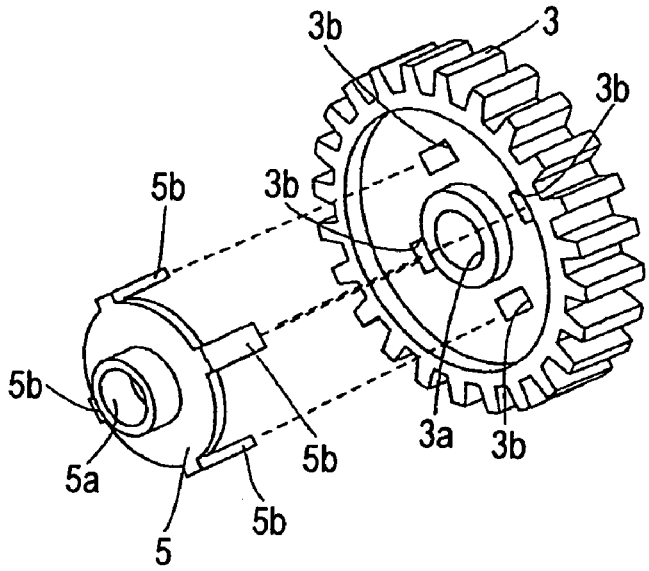
FIG. 5 is a disassembled perspective view for explaining the state of engaging the press-fit engaging member and the gear according to the first embodiment shown in FIG. 3.

FIG. 1 is a perspective view showing a total structure of a thermally transcribing printer according to a first embodiment of the invention. FIG. 2 and FIG. 3 are views partially showing a structure of the thermally transcribing printer according to the first aspect of the invention shown in FIG. 1. FIG. 4 and FIG. 5 are views showing structures of a gear and a press-fit engaging member of the thermally transcribing printer according to the first embodiment of the invention shown in FIG. 1. An explanation will be given of the structure of the thermally transcribing printer according to the first embodiment of the invention.

As shown by FIG. 1 and FIG. 2, the thermally transcribing printer according to the first embodiment of the invention includes a frame 1 made of a metal, a roller 2 made of a metal for feeding sheet at constant sheet, a gear 3 made of a resin, a motor 4, a press-fit engaging member 5 (refer to FIG. 3), a motor bracket 6 made of a metal, a compression coil spring 7 (refer to FIG. 3), bearing members 8 and 9 (refer to FIG. 3), an ink sheet winding gear 10, a roller shaft drive gear 11, middle gears 12 through 14, sheet charging and discharging roller 15, a roller shaft 16 of the sheet charging and discharging roller 15, an ink sheet case 17, and a sheet bottom receiving guide 18. Further, the thermally transcribing printer of the first embodiment is an example of an "image forming apparatus" of the invention.

As shown by FIG. 3, the frame 1 made of a metal is rotatably attached with the roller 2 made of a metal for feeding sheet at constant speed via the bearing members 8 and 9. The roller 2 includes one shaft portion 2*a* attached to the bearing member 9 to project from an inner side to an outer side of the frame 1, and other shaft portion 2*b* attached to the bearing member 8.

Here, according to the first embodiment, as shown by FIG. 3 and FIG. 4, the gear 3 made of a resin includes a circular shaft inserting hole 3*a* inserted with the shaft portion 2*a* of the shaft 2, and four engaging holes 3*b* provided at intervals of 90 degrees between the shaft inserting hole 3*a* and an outer peripheral portion of the gear 3 and having a predetermined hole length in a rotational direction. Further, the engaging hole 3*b* is an example of a "second engaging portion" of the invention. Further, as shown by FIG. 3 and FIG. 5, the press-fit engaging member 5 is formed with a shaft press-fitting portion 5*a* press-fitted with the shaft portion 2*a* of the roller 2 made of a metal and four engaging portions 5*b* engaged with the four engaging holes 3*b* of the gear 3 and having a length in the rotational direction equal to or larger than a length of the engaging hole 3*b* in the rotational direction. Further, the engaging portion 5*b* is an example of a "first engaging portion" of the invention. The engaging portion 5*b* is provided at a position on a circle having a radius larger than a radius of an inner diameter of the shaft press-fitting portion 5*a* in correspondence with the engaging hole 3*b*. Further, a length of the engaging portion 5*b* of the press-fit engaging member 5 is formed to be smaller than a length in a radius direction of the engaging hole 3*b* of the gear 3. Further, according to the first embodiment, as shown by FIG. 3, the compression coil spring 7 made of a metal is arranged between the press-fit engaging member 5 and the frame 1 to urge the press-fit engaging member 5 in an outer side direction of the frame 1.

Further, as shown by FIG. 1 and FIG. 2, the motor 4 is attached to the motor bracket 6 attached to the frame 1. The motor 4 functions as a drive source for driving the gear 3, the ink sheet winding gear 10 and the roller shaft drive gear 11 via the plurality of middle gears 12, 13 and 14.

Figure 6:
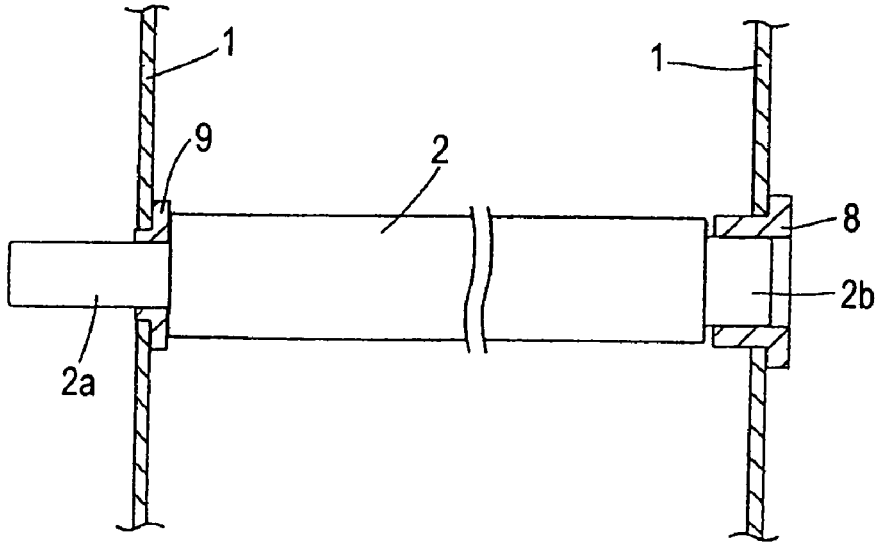
FIG. 6 is a sectional view for explaining an integrating step of the roller, the press-fit engaging member and the gear of the thermally transcribing printer according to the first embodiment of the invention.
Figure 7:
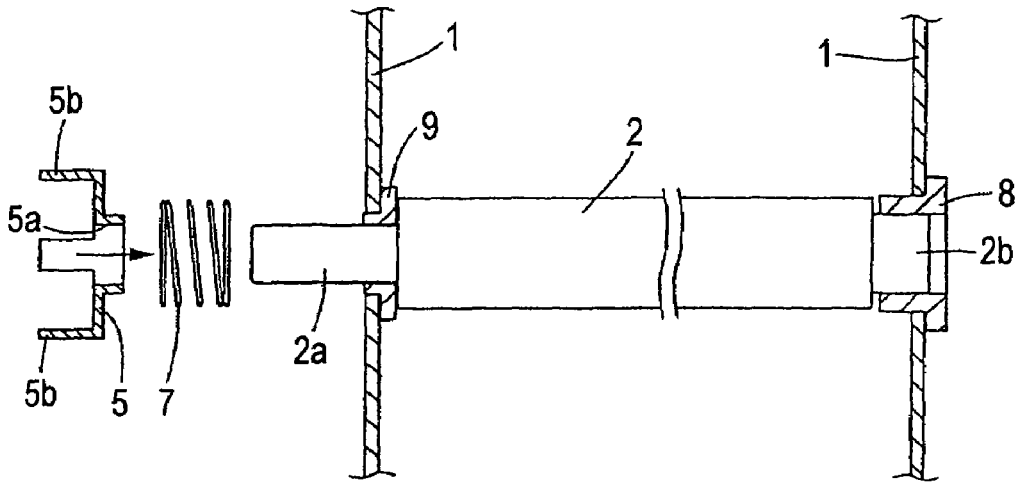
FIG. 7 is a sectional view for explaining an integrating step of the roller, the press-fit engaging member and the gear of the thermally transcribing printer according to the first embodiment of the invention.
Figure 8:
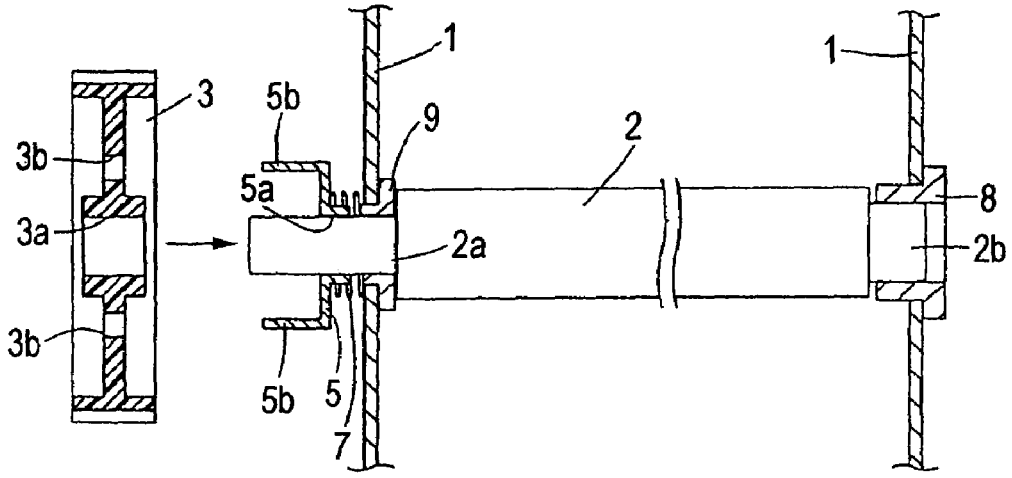
FIG. 8 is a sectional view for explaining an integrating step of the roller, the press-fit engaging member and the gear of the thermally transcribing printer according to the first embodiment of the invention.
Figure 9:
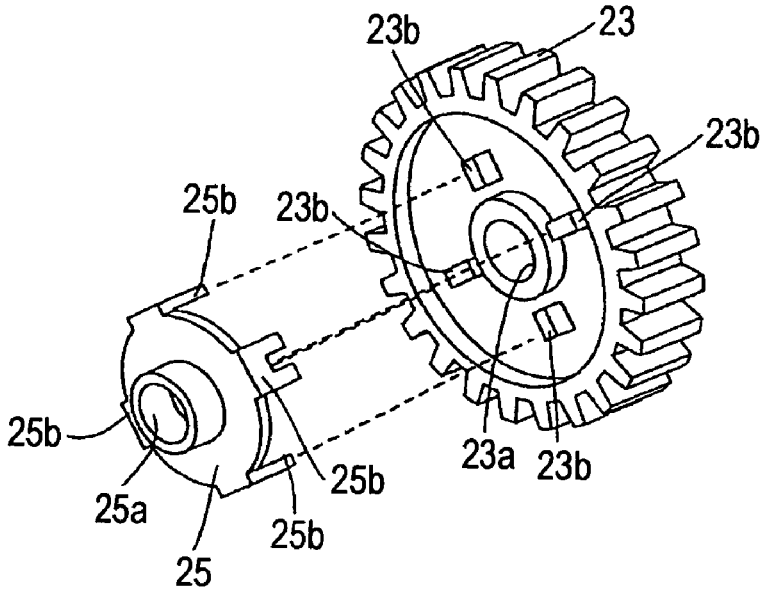
FIG. 9 is a disassembled perspective view for explaining a state of engaging a press-fit engaging member and a gear according to a second embodiment of the invention.
Figure 10:
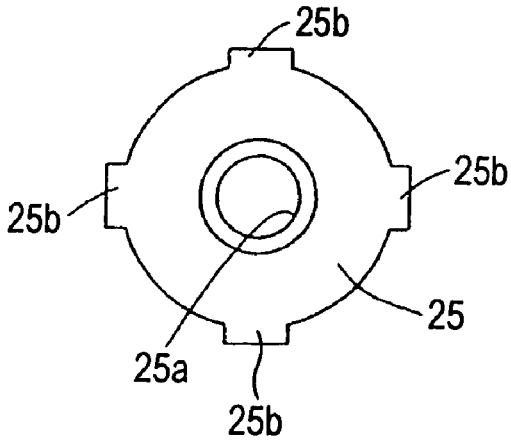
FIG. 10 is a front view of the press-fit engaging member according to the second embodiment of the invention.
Figure 11:
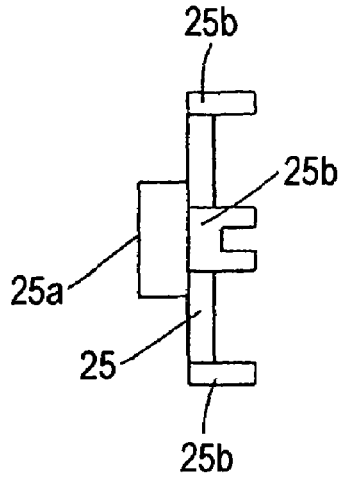
FIG. 11 is a side view of the press-fit engaging member according to the second embodiment of the invention.
Figure 12:
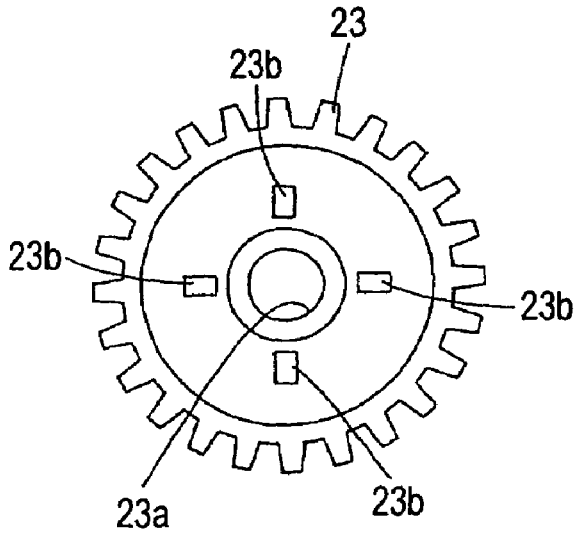
FIG. 12 is a front view of the gear according to the second embodiment of the invention.
Figure 13:
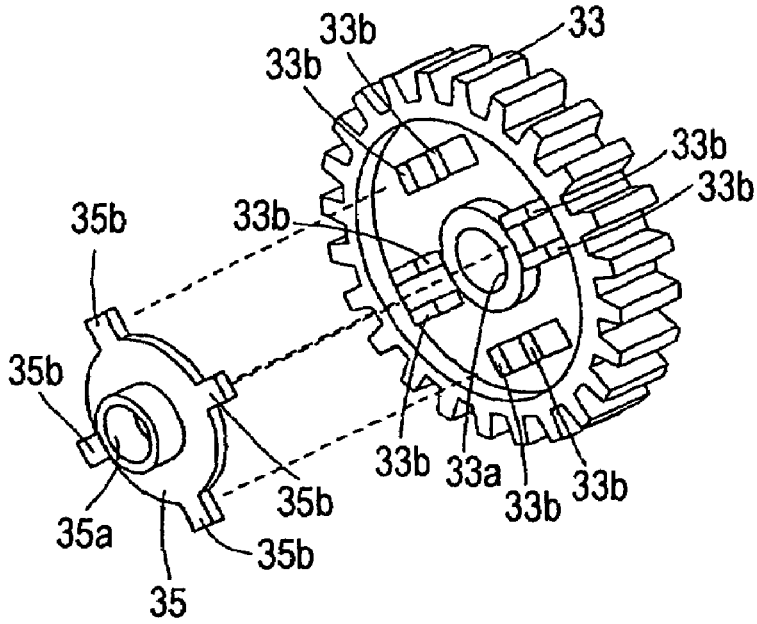
FIG. 13 is a disassembled perspective view for explaining a state of engaging a press-fit engaging member and a gear according to a third embodiment of the invention.
Figure 14:
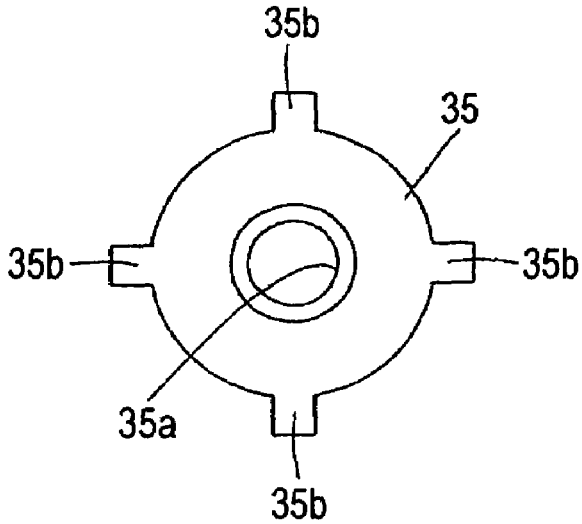
FIG. 14 is a front view of the press-fit engaging member according to the third embodiment of the invention.
Figure 15:
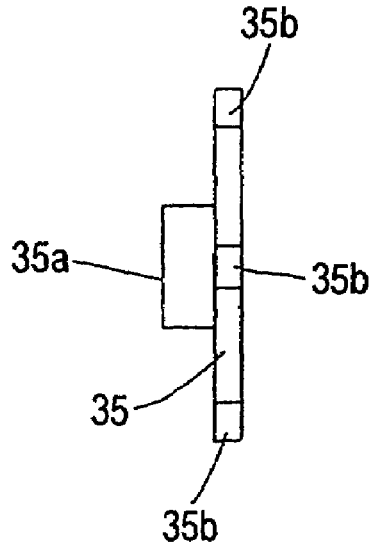
FIG. 15 is a side view of the press-fit engaging member according to the third embodiment of the invention.
Figure 16:
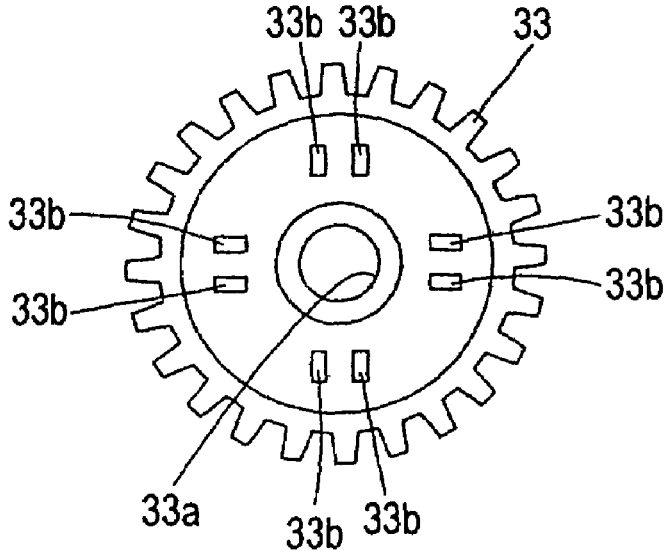
FIG. 16 is a front view of the gear according to the third embodiment of the invention.
Figure 17:
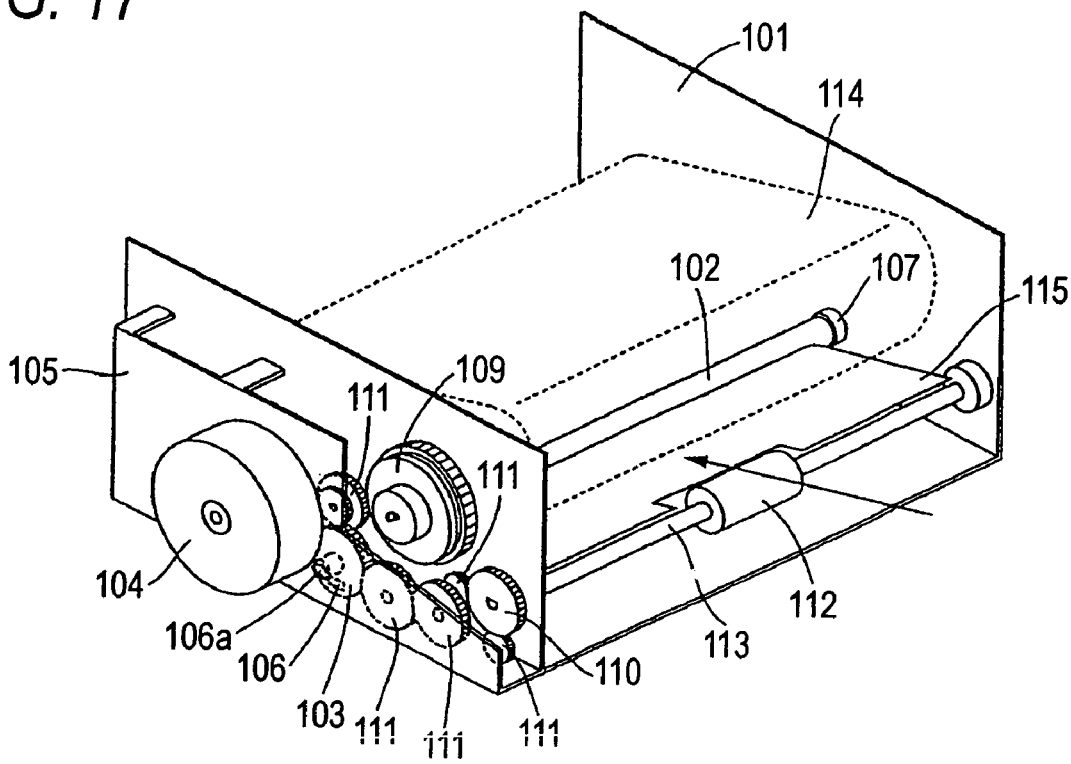
FIG. 17 is a perspective view showing a total constitution of a thermally transcribing printer of a background art.
Figure 18:
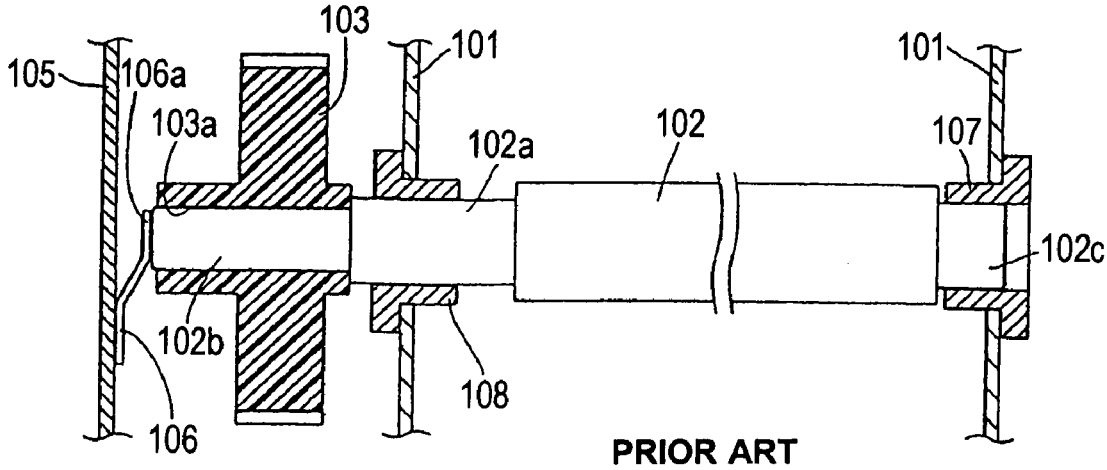
PRIOR ART FIG. 18
FIG. 18 is a sectional view showing a structure of attaching a roller and a gear for feeding sheet at constant speed of the background art shown in FIG. 17.
Figure 19:
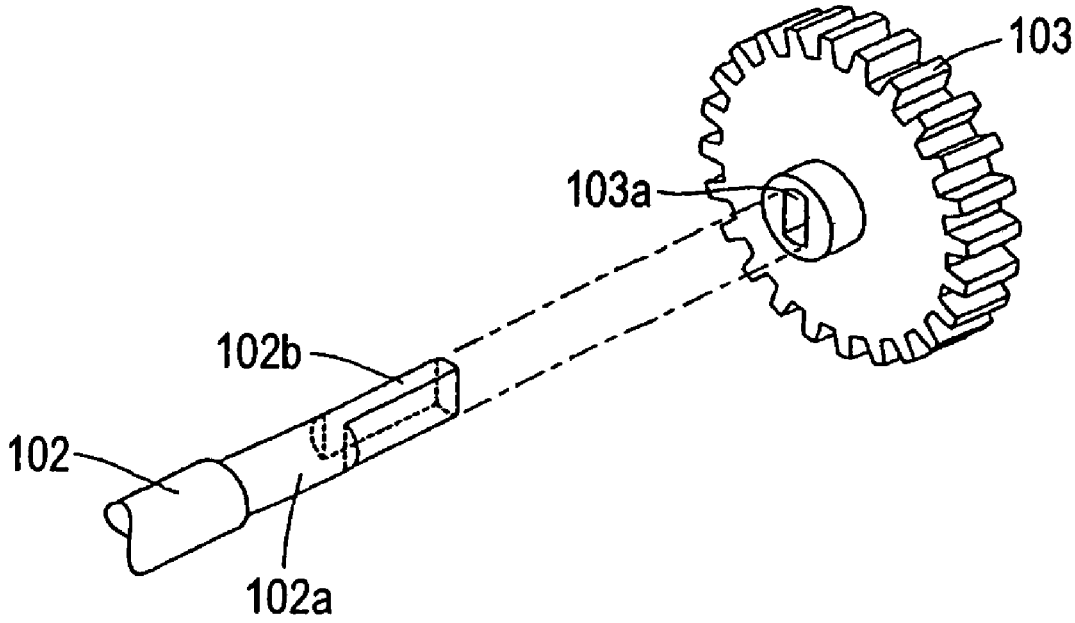
FIG. 19 is a perspective view showing the structure of attaching the roller for feeding sheet at constant speed of the background art shown in FIG. 18 to the gear.

FIG. 6 through FIG. 8 are sectional views for explaining integrating steps of the roller, the press-fit engaging member and the gear of the thermally transcribing printer according to the first embodiment of the invention. Next, an explanation will be given of the integrating steps of the roller 2, the press-fit engaging member 5 and the gear 3 of the thermally transcribing printer according to the first embodiment in reference to FIG. 6 through FIG. 8. First, as shown by FIG. 6, the shaft portions 2*a* and 2*b* of the roller 2 are rotatably attached to the frame 1 via the bearing members 8 and 9. Next, as shown by FIG. 7, the compression coil spring 7 is inserted into the shaft portion 2*a* from an outer side of the frame and the press-fitting portion 5*a* of the press-fit engaging member 5 is press-fitted to the shaft portion 2*a* from the outer side. Thereafter, as shown by FIG. 8, the shaft inserting hole 3*a* of the gear 3 is lightly press-fitted to the shaft portion 2*a* and the engaging holes 3*b* are press-fitted to engage with the engaging portions 5*b*. Thereby, as shown by FIG. 3, the shaft portion 2*a* of the roller 2 and the gear 3 are connected so as not to be rotated idly. In this way, the roller 2, the press-fit engaging member 5 and the gear 3 are integrated.

Next, an explanation will be given of operation of the thermally transcribing printer according to the first embodiment in reference to FIG. 1 and FIG. 2. First, when the motor 4 is rotated in an arrow mark A direction (refer to FIG. 2), the middle gear 12 is rotated in an arrow mark B direction, and the middle gear 13 is rotated in an arrow mark C direction. At this occasion, the gear 3 is rotated in an arrow mark D direction. Further, similarly, when the gear 3 is rotated, the ink sheet winding gear 10 and the roller shaft drive gear 11 are rotated via the plurality of middle gears 14. In this way, a drive force of the motor 4 is transmitted to the gear 3, the ink sheet winding gear 10 and the roller shaft drive gear 11 via the plurality of middle gears 12, 13 and 14. Thereby, the drive force is transmitted from the gear 3 to the roller 2 via the press-fit engaging member and therefore, the roller 2 is rotated while being supported by the bearing members 8 and 9. As a result, sheet (not illustrated) is fed at constant speed. Further, the drive force is transmitted from the ink sheet winding gear 10 also to an ink sheet winding roller shaft (not illustrated) and therefore, ink sheet (not illustrated) is wound. Further, the drive force is transmitted from the roller shaft drive gear 11 to the roller shaft 16 of the sheet charging and discharging roller 15 and therefore, sheet (not illustrated) is carried in a sheet charging direction or a sheet discharging direction.

According to the embodiment, as described above, the shaft portion 2*a* of the roller 2 and the gear 3 can be connected so as not to be rotated idly by providing the four engaging holes 3*b* at the gear 3 for rotating the roller 2 made of a metal for feeding sheet at constant speed and providing the press-fit engaging member 5 having the shaft press-fitting portion 5*a* press-fitted to the shaft portion 2*a* of the roller 2 and the four engaging portions 5*b* engaged with the engaging holes 5*b* of the gear 3 without providing an oval shape portion or a pin inserting hole at the shaft portion 2*a* of the roller 2. Thereby, the shaft portion 2*a* of the roller 2 and the gear 3 can be rotated so as not to be rotated idly without forming the oval shape portion, the pin inserting hole or the like requiring a time period in working to the shaft portion 2*a* of the roller 2. As a result, a time period of working the shaft portion 2*a* of the roller 2 can be reduced and therefore, working cost can be reduced.

Further, according to the first embodiment, by providing the compression coil spring 7 made of a metal for urging the press-fit engaging member 5 in an outer side direction of the frame 1 between the press-fit engaging member 5 made of a metal and the frame 1 made of a metal, static electricity generated between the roller 2 made of a metal and sheet or the bearing members 8 and 9 is escaped to the side of the frame via the press-fit engaging member 5 and the compression coil spring 7. Thereby, the roller 2 can be grounded to the frame 1 and therefore, a failure of the apparatus caused by static electricity of the roller 2 can be prevented. Further, according to the first embodiment, the press-fit engaging member 5 is urged in the outer side direction of the frame 1 and therefore, the roller 2 can be restrained from being moved in the horizontal direction when the roller 2 feeds sheet at constant speed. As a result, accuracy of feeding sheet can be promoted.

Further, according to the first embodiment, by engaging the four engaging holes 3*b* provided at intervals of 90 degrees between the shaft inserting hole 3*a* of the gear 3 and an outer peripheral portion of the gear 3 with the four engaging portions 5*b* of the press-fit engaging member 5 in correspondence therewith, the drive force is transmitted by the four connecting portions. Thereby, in transmitting the drive force transmitted from the motor 4 from the gear 3 to the roller 2 via the press-fit engaging member 5, even when a large load is applied thereto, the large load is dispersed to the four connecting portions and therefore, the gear 3 made of a resin can be restrained from being destructed.

Further, according to the first embodiment, by providing the engaging portion 5*b* having the length in the rotational direction equivalent to or larger than the length in the rotational direction of the engaging hole 3*b* of the gear 3 at the press-fit engaging member 5, the engaging hole 3*b* of the gear 3 and the engaging portion 5*b* of the press-fit engaging member 5 can be press-fitted to engage without a clearance therebetween in the rotational direction. Thereby, in transmitting the drive force transmitted from the motor 4 from the gear 3 to the press-fit engaging member 5, play (rattle) can be restrained from being produced between the gear 3 and the press-fit engaging member 5 in the rotational direction. As a result, accuracy of feeding sheet can further be promoted.

Second Embodiment

FIG. 9 through FIG. 12 are views showing structures of a gear and a press-fit engaging portion of a thermally transcribing printer according to a second embodiment of the invention. According to the second embodiment, an explanation will be given of a structure of a connecting portion of a gear and a press-fit engaging member different from those of the first embodiment in reference to FIG. 9 through FIG. 12.

That is, according to the second embodiment, a gear 23 made of a resin includes a shaft inserting hole 23*a* in a circular shape inserted into the shaft portion 2*a* of the roller 2 and four ribs 23*b* provided at intervals of 90 degrees between the shaft inserting hole 23*a* and an outer peripheral portion of the gear 23 and having a predetermined engaging length in a rotational direction. Further, the rib 23*b* is an example of the "second engaging portion" of the invention. Further, a press-fit engaging member 25 is formed with a shaft press-fitting portion 25*a* press-fitted to the shaft portion 2*a* of the roller 2 made of a metal and engaging portions 25*b* having bifurcated front end portions branched to pinch the four ribs 23*b* of the gear 23. Further, the engaging portion 25*b* is an example of the "first engaging portion" of the invention. Here, an interval between the bifurcated branch portions of the engaging portions 25*b* is formed by a size equivalent to or smaller than a thickness in the rotational direction of the rib 23*b* of the gear 23. A structure of a portion of the second embodiment other than the above-described is similar to that of the above-described thermally transcribing printer according to the first embodiment.

According to the second embodiment, as described above, the shaft portion 2*a* of the roller 2 and the gear 23 can be connected so as not to be rotated idly by engaging the bifurcated branch portions of the press-fit engaging member 25 and the ribs 23*b* of the gear 23 by providing the front end portions having the bifurcated branch portions at the engaging portions 25*b* of the press-fit engaging member 25 and providing the ribs 23*b* pinched by the branch portions of the front end portions of the engaging portions 25*b* easily without providing a oval shape portion, a pin inserting hole or the like at the shaft portion 2*a* of the roller 2.

Further, according to the embodiment, the ribs 23*b* of the gear 23 and the engaging portions 25*b* of the press-fit engaging member 25 are press-fitted to engage without a clearance therebetween in the rotational direction by forming the interval between the bifurcated branch portions of the engaging portion 25*b* by the size equivalent to or smaller than the thickness in the rotational direction of the rib 23*b* of the gear 23. Thereby, in transmitting the drive force transmitted from the motor 4 from the gear 23 to the press-fit engaging member 25, play (rattle) can be restrained from being produced between the gear 23 and the press-fit engaging member 25 in the rotational direction. As a result, accuracy of feeding sheet can further be promoted.

Further, the other effect of the second embodiment is similar that of the above-described first embodiment.

Third Embodiment

FIG. 13 through FIG. 16 are views showing structures of a gear and a press-fit engaging member of a thermally transcribing printer according to a third embodiment of the invention. According to the third embodiment, an explanation will be given of a structure of a connecting portion of a gear and a press-fit engaging member different from those of the first embodiment and the second embodiment.

That is, according to the third embodiment, a gear 33 made of a resin includes a shaft inserting hole 33*a* in a circular shape inserted into the shaft portion 2*a* of the roller 2, and four sets of pairs of ribs 33*b* provided at intervals of 90 degrees between the shaft inserting hole 33*a* and an outer peripheral portion of the gear 33. Further, the pair of ribs 33*b* are an example of the "second engaging portion" of the invention. Further, a press-fit engaging member 35 is formed with a shaft press-fitting portion 35*a* press-fitted to the shaft portion 2*a* of the roller 2 made of a metal and engaging portions 30*b* engaged with four sets of the pair of ribs 33*b* of the gear 33 and including projected pieces having a length in a rotational direction equivalent to or larger than an interval in the rotational direction between the pair of ribs 33*b*. Further, the engaging portion 35*b* is an example of the "first engaging portion" of the invention. A structure of a portion of the third embodiment other than the above-described is similar to those of the thermally transcribing printers according to the first embodiment and the second embodiment.

According to the third embodiment, the shaft portion 2*a* of the roller 2 and the gear 33 can be connected so as not to be rotated idly by providing the engaging portions 35*a* including the projected pieces at the press-fit engaging member 35 and providing the pairs of ribs 33*b* for holding to pinch the engaging portions 35*b* including the projected pieces at the gear 33 easily without providing an oval shape portion, a pin inserting hole or the like at the shaft portion 2*a* of the roller 2.

Further, according to the third embodiment, the ribs 33*b* of the gear 33 and the engaging portions 35*b* of the press-fit engaging member 35 are press-fitted to engage without clearances therebetween in the rotational direction by forming the engaging portions 35*b* including the projected pieces of the press-fit engaging member 35 to provide the length in the rotational direction equivalent to or larger than the interval in the rotational direction between the pair of ribs 33*b* of the gear 33. Thereby, in transmitting the drive force transmitted from the motor 4 from the gear 33 to the press-fit engaging member 35, play (rattle) can be restrained from being produced between the gear 33 and the press-fit engaging member 35. As a result, accuracy of feeding sheet can further be promoted.

Further, the other effect of the third embodiment is similar to that of the above-described first embodiment.

Further, the embodiments disclosed this time are to be regarded to be exemplifications and not to be restrictive in all the aspects. The range of the invention is shown not by the above-described explanation of the embodiments but by the scope of claims, and includes all the modifications within the significance and the range equivalent to the scope of claims.

For example, although according to the above-described first through third embodiments, the thermally transcribing printer is shown as the example of the image forming apparatus, the invention is not limited thereto but is applicable also to other image forming apparatus of an ink jet printer, a laser printer or the like other than the thermally transcribing printer.

Further, although according to the above-described first through third embodiments, there is shown an example of engaging the second engaging portion of the gear to press-fit to the first engaging portion of the press-fit engaging member, the invention is not limited thereto but it is not necessarily needed to press-fit the second engaging portion to the first engaging portion so far as an engaging state without a clearance (play) between the first engaging portion of the press-fit engaging member and the second engaging portion of the gear is constituted.

Further, although according to the above-describe first through third embodiment, in inserting the shaft inserting hole of the gear to the shaft portion of the roller, the shaft inserting hole is lightly press-fitted to the shaft portion, the invention is not limited thereto but the shaft inserting hole may be inserted into the shaft portion of the roller without press-fitting the shaft inserting hole to the shaft portion.

Further, although according to the above-described first through third embodiment, there is shown an example that the gear is made of a resin, the invention is not limited thereto but is applicable also to a gear made of a metal.

What is claimed is:

1. An image forming apparatus comprising:

a roller for feeding a sheet, the roller including a shaft portion;

a press-fit engaging member including a shaft press-fitting portion press-fitted to the shaft portion of the roller and a first engaging portion;

a gear attached to the shaft portion of the roller and including a second engaging portion engageable with the first engaging portion of the press-fit engaging member;

a frame rotatably attached with the roller; and a compression coil spring made of a metal arranged between the press-fit engaging member and the frame for urging the press-fit engaging member in a direction of an outer side of the frame.

2. The image forming apparatus according to claim 1, wherein each of the frame, the roller and the press-fit engaging member is made of a metal.

3. The image forming apparatus, according to claim 1, wherein:

the gear includes a shaft inserting hole in a circular shape inserted from an outer side of the press-fit engaging member to the shaft portion of the roller;

a plurality of the second engaging portions of the gear are provided at intervals of a predetermined angle between the shaft inserting hole and an outer peripheral portion of the gear; and a plurality of the first engaging portions of the press-fit engaging member are provided at positions in correspondence with the second engaging portions of the gear and engaged with the plurality of second engaging portions of the gear.

4. The image forming apparatus according to claim 1, wherein:

the first engaging portion of the press-fit engaging member includes a projected piece projected to a side of the second engaging portion of the gear; and the second engaging portion of the gear includes an engaging hole engageable with the projected piece of the press-fit engaging member.

5. The image forming apparatus according to claim 4, wherein the projected piece of the press-fit engaging member is provided with a length in a rotational direction equivalent to or larger than a length in the rotational direction of the engaging hole of the gear.

6. The image forming apparatus according to claim 1, wherein:

the gear is in direct contact with the shaft portion of the roller.

7. The image forming apparatus according to claim 1, wherein:

the shaft portion includes a cylindrical portion to which the shaft press-fitting portion of the press-fit engaging member is press-fitted and to which the gear is attached.

8. The image forming apparatus according to claim 1, wherein:

the press-fit engaging member and the gear are aligned in an axial direction of the roller on the shaft portion.

9. An image forming apparatus comprising:

a roller for feeding a sheet, the roller including a shaft portion;

a press-fit engaging member including a shaft press-fitting portion press-fitted to the shaft portion of the roller and a first engaging portion; and a gear attached to the shaft portion of the roller and including a second engaging portion engageable with the first engaging portion of the press-fit engaging member;

wherein:

the first engaging portion of the press-fit engaging member includes a front end portion having bifurcated branch portions; and the second engaging portion of the gear includes a rib pinched by the branch portions of the front end portion of the first engaging portion.

10. An image forming apparatus comprising:

a roller for feeding a sheet, the roller including a shaft portion;

a press-fit engaging member including a shaft press-fitting portion press-fitted to the shaft portion of the roller and a first engaging portion; and a gear attached to the shaft portion of the roller and including a second engaging portion engageable with the first engaging portion of the press-fit engaging member;

wherein:

the first engaging portion of the press-fit engaging member includes a projected piece; and the second engaging portion of the gear includes a pair of ribs for holding to pinch the projected piece of the first engaging portion.

11. A thermally transcribing printer including a frame made of a metal, a roller made of a metal including a shaft portion attached to the frame to project from an inner side to an outer side of the frame via a bearing member for feeding a sheet at a constant speed, a gear made of a resin attached to a portion of the shaft portion of the roller projected to the outer side of the frame for rotating the roller, and a drive motor for driving to rotate the gear, the thermally transcribing printer comprising:

a press-fit engaging member made of a metal press-fitted to the portion of the shaft portion of the roller projected to the outer side of the frame and engaged with the gear; and a compression coil spring made of a metal arranged between the press-fit engaging member and the frame for urging the press-fit engaging member in a direction of the outer side of the frame, wherein:

the gear made of the resin includes a shaft inserting hole in a circular shape inserted from an outer side of the press-fit engaging member to the shaft portion of the roller, and a plurality of engaging holes provided at intervals of a predetermined angle between the shaft inserting hole and an outer peripheral portion of the gear and having a predetermined hole length in a rotational direction; and the press-fit engaging member includes a shaft press-fitting portion press-fitted to the shaft portion of the roller made of the metal and a plurality of engaging portions provided at positions in correspondence with the engaging holes, engaged with the plurality of engaging holes of the gear and including a length in a rotational direction equivalent to or larger than a length in the rotational direction of the engaging hole.

* * * * *